United States Patent [19]

Kozlof

[11] Patent Number: 4,772,221

[45] Date of Patent: Sep. 20, 1988

[54] PANEL MOUNT CONNECTOR FILTER ASSEMBLY

[75] Inventor: Frederick P. Kozlof, Scarborough, Canada

[73] Assignee: Amphenol Corporation, Wallingford, Conn.

[21] Appl. No.: 934,881

[22] Filed: Nov. 25, 1986

[51] Int. Cl.[4] ..... H01R 13/74

[52] U.S. Cl. ..... 439/549; 439/620

[58] Field of Search ..... 333/181, 182, 206; 361/302; 439/620, 544

[56] References Cited

U.S. PATENT DOCUMENTS 4,202,594 5/1980 Coleman et al. ..... 439/620 X 4,229,714 10/1980 Yu ..... 333/182 X

*Primary Examiner*—Eugene F. Desmond

*Attorney, Agent, or Firm*—Bacon & Thomas

[57] ABSTRACT

The invention is directed to a filter assembly for use on BNC type front panel mount connectors. The assembly establishes a capacitance between a BNC type front panel mount connector and a panel upon which the connector is mounted for filtering high frequency interference by passing high frequencies from the connector body, which is in electrical contact with a cable shield, to the panel and to ground therefrom. In accordance with the invention, the filter assembly includes a capacitor housing for housing capacitors therein. Preferably the capacitors are of the ceramic chip type. The housing is made of insulative material and is constructed for being mounted on the body of the connector when the connector is mounted on the conductive panel. A first conductive washer is on one side of the panel between the capacitor housing and the panel, and is in contact between the capacitors and the panel. A second conductive washer is mounted on the other side of the housing and establishes contact between the panel through the first washer and the capacitors to the connector and to a coaxial cable shield connected to the connector. A locking arrangement holds the entire assembly onto the connector body.

7 Claims, 7 Drawing Sheets

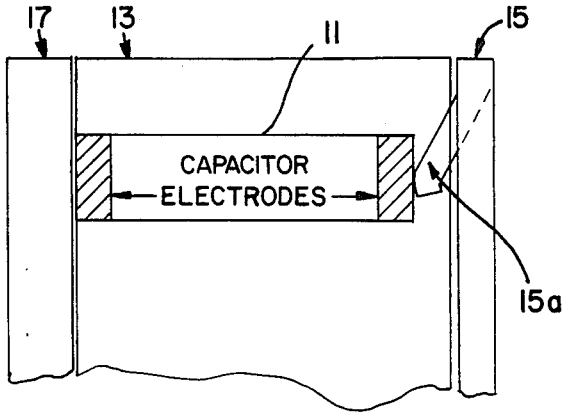
FIG. 8
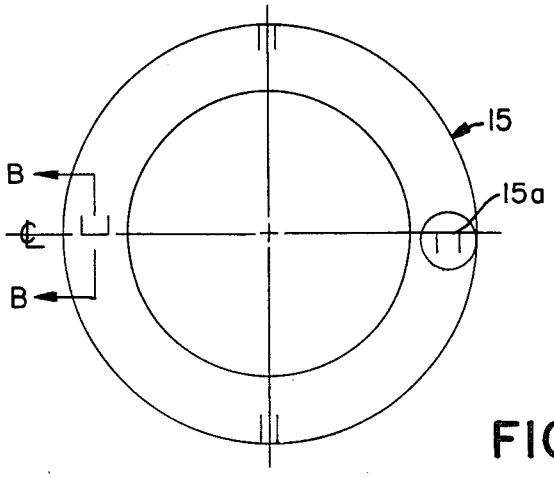
FIG. 9
FIG. 10b
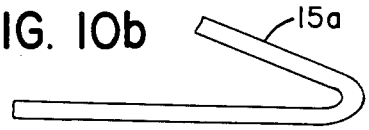
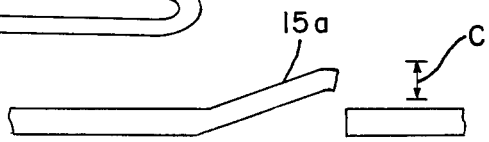
FIG. 10a (SEE FIG. 7 "13a")

PANEL MOUNT CONNECTOR FILTER ASSEMBLY

BACKGROUND OF THE INVENTION

This invention relates to a filter kit assembly for use, for example, with a panel mount BNC type connector, for filtering the shield of a cable connected to the housing of the connector through a filter, for example, a capacitor, to the panel upon which the connector is mounted, and therefrom to ground.

BNC connectors and coaxial cables are typically employed in applications wherein it is desirable to filter and shield transmissions through conductors connected thereto from outside electromagnetic interference, i.e., EMI, or vice versa. Filtering and shielding are methods of controlling EMI. They may be used independently or together. In this context, for example, such connectors are employed in computer applications wherein data transmissions through the cables employed, typically which are coaxial cables of the type having an electromagnetic shield surrounding an inner conductor, must be protected from electromagnetic interference or interference emissions from the computer must be avoided. In the case of computer applications, such BNC type connectors are often mounted on panels which are made of metallic conducting material, and which lead to a ground. It is typical that in this case, it is desirable to prevent emanation of high frequency signals from a shielded coaxial cable into the environment or from the environment into the equipment. Such a connector then is typically mounted on a panel in electrical contact therewith, and as shown in FIG. 1, the prior art typically involved connecting, by means of leads, a capacitor in a series circuit arrangement to the panel from the outside of the connector housing.

Although generally working satisfactorily for the purpose of shielding high frequency signals and routing them to ground through the filter capacitor, such an arrangement was typically complicated and difficult to assemble and was susceptible to disconnection. Also, the inherent inductance of the leads of the capacitor diminishes the effectiveness of conventional filters at high frequency.

In accordance with the invention, such problems are avoided.

SUMMARY OF THE INVENTION

In accordance with the invention, there is provided an improvement in a BNC type, front panel mount connector filter assembly of the type wherein a capacitance is established between a BNC type, front panel mount connector and a panel upon which the connector is mounted for filtering high frequency interference by passing high frequencies from the connector body, which connector body is in electrical contact with a cable shield, to the panel.

The improvement in accordance with the invention is defined as having the filter assembly comprising capacitor housing means for having capacitors mounted therein. The capacitor housing means is made of electrically insulative material and is constructed for being mounted on the body of the connector when the connector is mounted on a conductive panel. First conductive washer means serve to establish electrical contact between one lead of each capacitor, mounted in the capacitor housing means, and the panel, and is constructed for being mounted on the body of the connector on one side of the capacitor housing means. Second conductive washer means serve to establish electrical contact between another lead of each capacitor mounted in the capacitor housing and a shield of a cable electrically connected to the connector body. The second washer means is constructed for being mounted on the body of the connector on the other side of the capacitor housing means and in electrical contact therewith. Lock means serve to hold the filter assembly on the connector body in contact with the panel upon which the connector is mounted.

In a more specific aspect, the capacitor housing means comprises a ring made of insulating material having capacitor housings therein, with the insulating material preferably being a plastic material and the capacitors being ceramic chip capacitors. Still more preferably, the capacitors are connected in parallel circuit arrangement relative to each other between the panel and the shield of a cable. This provides a high improvement over conventional leaded capacitors because it reduces the inductance and resistance of the ground path providing much greater shielding capability.

In still yet another aspect, the ring making up the capacitor housing houses at least two capacitors, but as will be appreciated, greater numbers of capacitors may be housed depending upon the specific application to which the invention is applied. Moreover, insulating means is preferably provided such that any electrical path between the connector housing and the panel is through the capacitors.

In a still further and more preferred aspect, the capacitor housing means and first and second conductive washer means are interconnected together as one single unit. One way of effecting this interconnection is by means of adhesive. Still another way of effecting this interconnection is by means of a snap-lock engagement. In addition, the lock means in accordance with another preferred aspect comprises a lock washer and hex nut threadable onto the housing of a connector. In a still further aspect, the invention also comprises the combination of a filter assembly as broadly described above with a BNC connector mounted on a panel.

BRIEF DESCRIPTION OF THE DRAWINGS

Having briefly described the invention the same will become better understood from the following detailed discussion taken in conjunction with the appended drawings wherein:

FIG. 8 is a partial side cross-sectional view at one end of the housing for the filter assembly in accordance with the invention showing a capacitor mounted therein and establishing contact between two conductive washers which establish the conductive path through the capacitor;

FIG. 9 is a front view of a conductor washer assembly in accordance with the invention showing a spring contact employed to establish contact with the capacitors in the filter assembly;

Figure 1O*a* is a partial cross-sectional view taken along lines BB of FIG. 9 showing the spring contact;

FIG. 10*b* is a view of an alternative construction of the spring contact;

DETAILED DISCUSSION OF THE INVENTION

Figure 1:
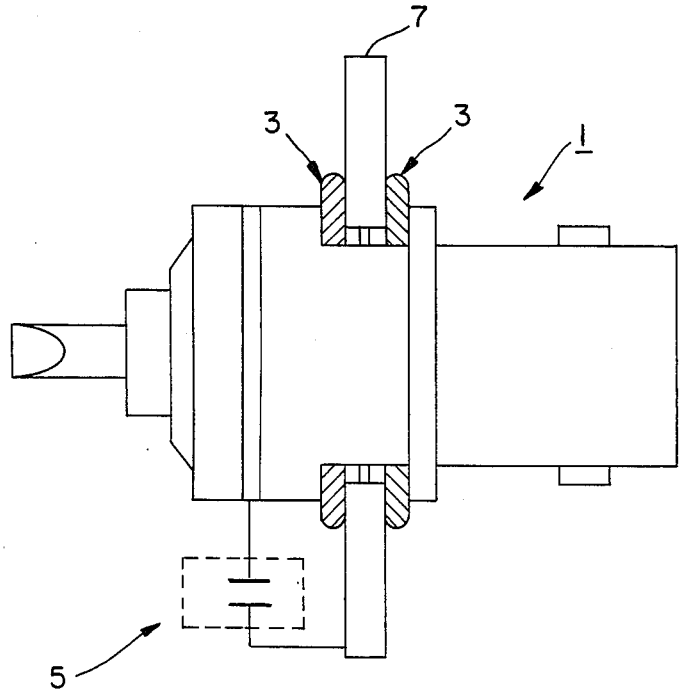
PRIOR ART FIG. 1
FIG. 1 is a side view of a typical prior art filter connector assembly attached to a BNC type connector mounted on a panel such as, for example, the back panel of a personal computer terminal.

The typical prior art BNC connector type filter assembly is shown in FIG. 1. As shown therein, such a filter assembly is typically employed on a panel mountable BNC connector 1. The panel mountable BNC connector 1 is mounted on a panel 7 which is conductive and connected to ground but is insulated therefrom by means of an insulating washer 3. In order to provide shielding, a filter assembly comprising a capacitor 5 is attached to the connector housing and by means of leads attached to the panel.

This type of assembly while generally working satisfactorily is cumbersome to assemble and can be easily damaged. Moreover, due to the series path of the single filter, a high impedance to ground is provided and thus, the shielding is not as effective as would be desirable.

Figure 2:
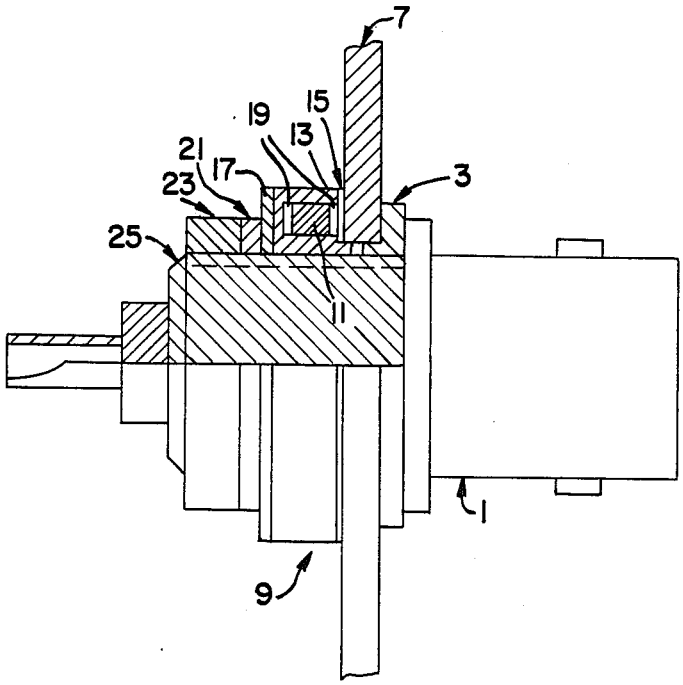
FIG. 2 is a view as in FIG. 1, shown in partial cross-section, of the filter assembly in accordance with the invention shown mounted on a BNC type connector which is itself mounted on a panel which serves as an electrical path to ground.

In accordance with the invention as shown in FIG. 2, a BNC connector 1 is mounted on a panel 7. Insulative washer 3 serves to isolate the connector housing from electrical contact with the panel 7. This combines with a capacitor housing ring 13 which is of a plastic and insulative nature and which as seen from FIG. 2 in the partial cross-sectional view thereof, also cooperates with washer 3 by providing a lip which isolates the connector housing from the panel 7. The capacitor housing which comprises an insulative ring 13, preferably a plastic ring 13, includes capacitor housings for housing capacitors 11 therein. preferably these capacitors are of the type known as ceramic chip capacitors with no leads. Moreover, preferably more than one, i.e., at least two capacitors 11 are mounted in a parallel circuit arrangement within the housing 13. The parallel circuit arrangement provides for a low impedance path which increases the filtering effectiveness of the arrangement. A first metal or conductive washer 15 is mounted on one side of the housing 13 and establishes electrical contact with one termination 19 of capacitor 11 and serves as a conductive path from the capacitor 11 to the panel 7. A second conductive washer 17 of like material to that of washer 15 also contacts the capacitor 11 at another termination 19 of the capacitor 11 to establish a conductive path between the metal panel 7 and a shield of a coaxial cable which is attached to the metal housing 1 (not shown). Thus, the two washers 17 and 15, the capacitors 11 having termination 19 and the capacitor housing ring 13 make up the filter assembly 9. The filter assembly 9 is held on the connector housing 1 by means of a lock washer 21 and hex nut 23 Which is threaded on to threads 25 on the back side of the connector housing.

Figure 3:
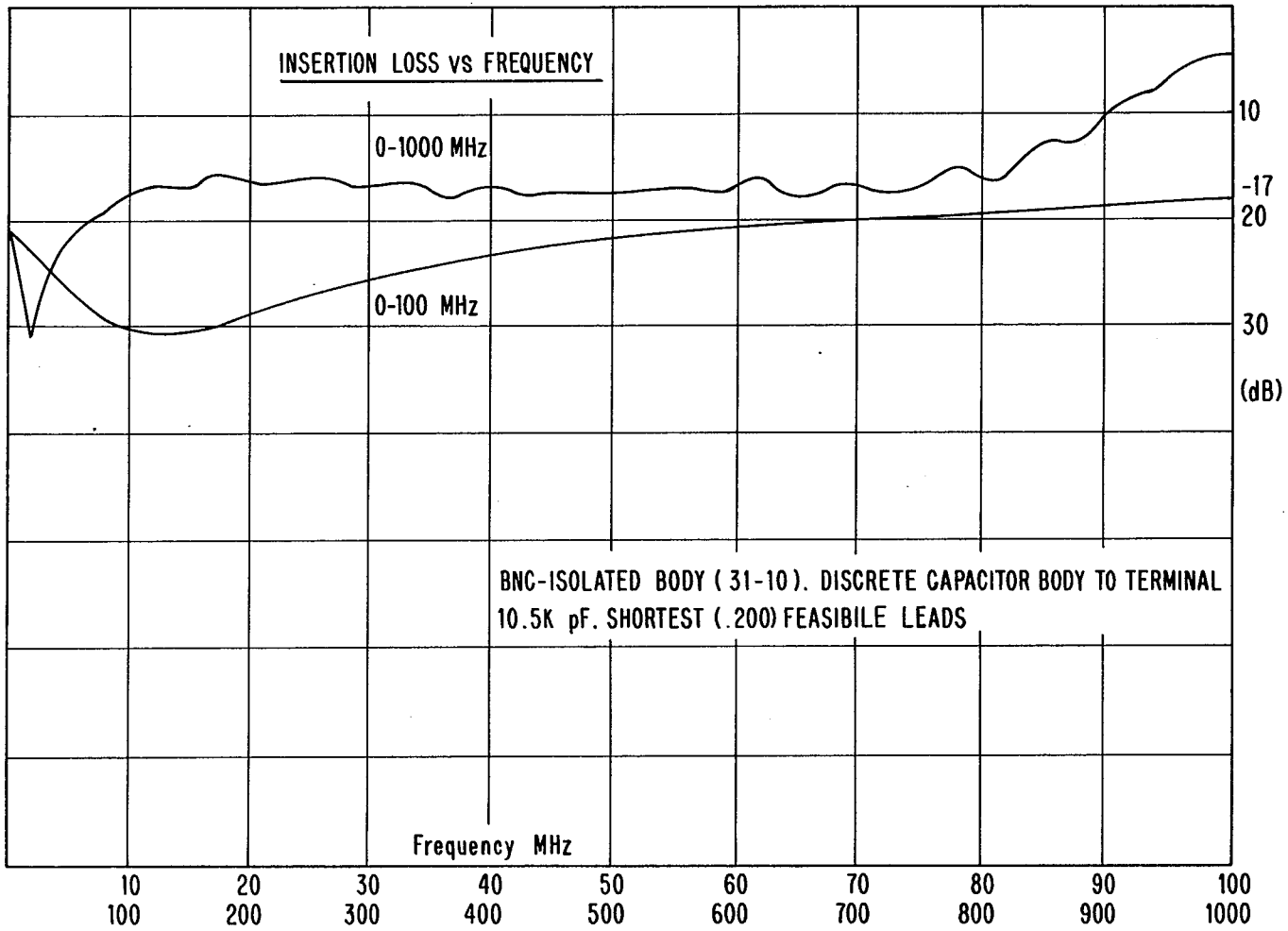
PRIOR ART FIG. 3
FIG. 3 is a graph showing typical insertion losses versus frequency of the filter assembly in accordance with the prior art such as that shown in FIG. 1.
Figure 4:
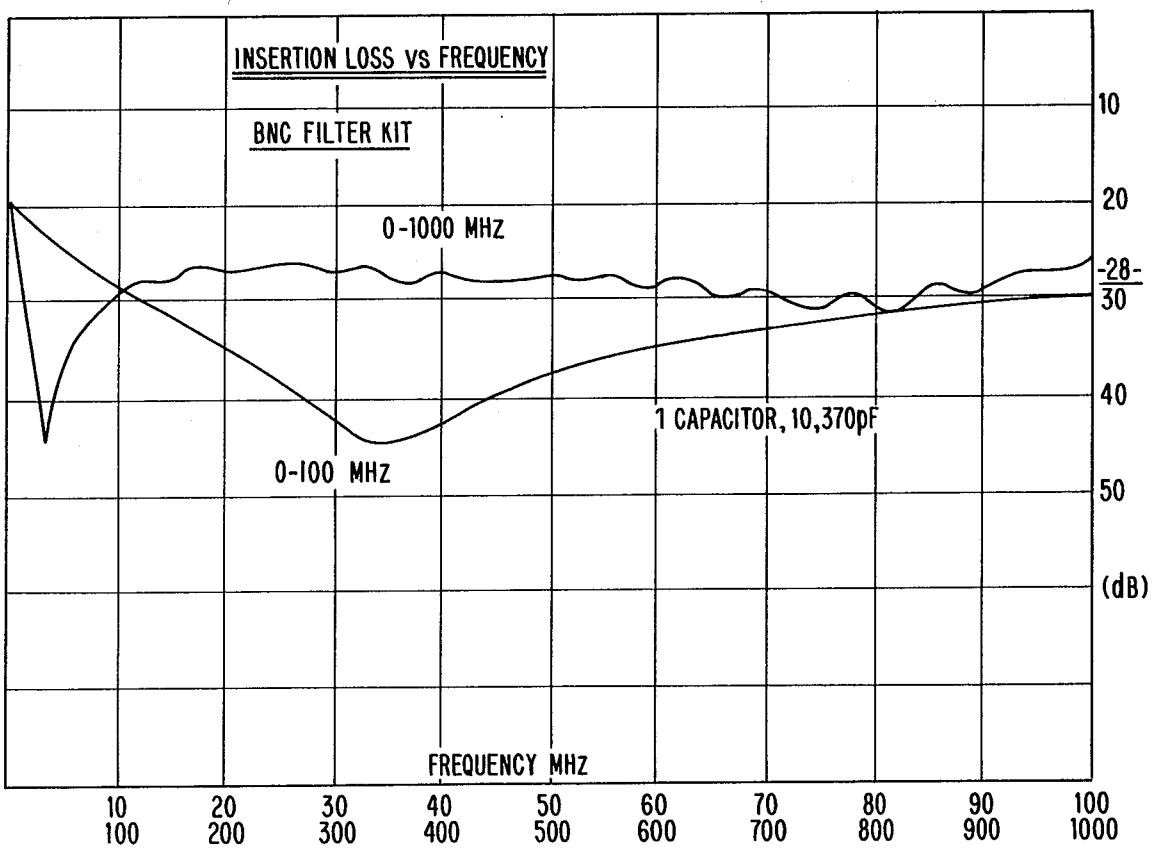
FIG. 4 shows insertion losses versus frequency in accordance with FIG. 3, but showing the improvement in performance by using the filter assembly in accordance with the invention.

FIGS. 3 and 4 illustrate by comparison the difference in filtering efficiency at high frequencies between the filter assembly in accordance with the invention and that of the prior art shown in FIG. 1. In accordance with the invention, for purposes of comparison with the prior art, one single capacitor was mounted in the housing, which capacitor had a capacitance of 10.37K pF as compared to the discrete capacitor body to terminal arrangement in accordance to FIG. 1 which was compared with a capacitor of 10.5K pF at different frequencies. As can be seen from the results of F1GS. 3 and 4, the capacitor filter arrangement in accordance with the invention provides greatly increased frequency filtering capabilities at higher frequencies. Moreover, as can be seen the simple interconnected arrangement of the invention is very easily assembled onto preexisting BNC type connector assemblies and is more effective and less cumbersome to use relative to the filter assembly in accordance with the prior art. In this specific arrangement for the capacitance values selected the use of the filter assembly is, for example, in a LAN system within a PC network wherein a certain amount of filtering is required in the computer system. However, although a capacitance value of 10.37K pF has been indicated, the filter assembly in accordance with the invention can be used in a wide range of capacitance values ranging anywhere from 10pF to 50,000pF.

Figure 5:
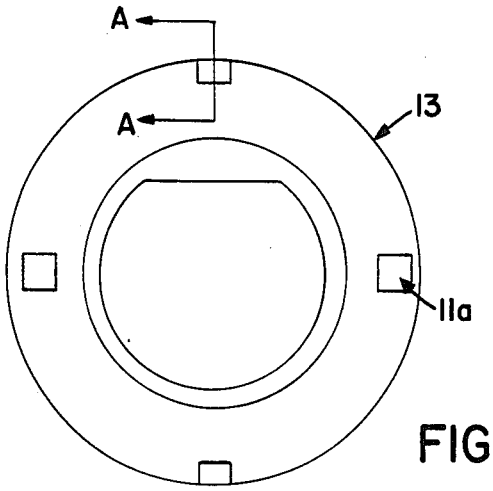
FIG. 5 is a front view of the capacitor housing ring in accordance with the invention showing dual capacitor housing cavities therein.
Figure 6:
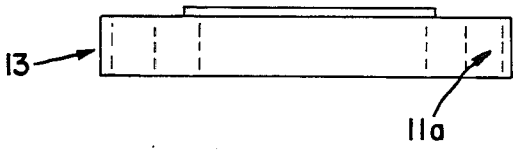
FIG. 6 is a side view of the housing of FIG. 5.
Figure 7:
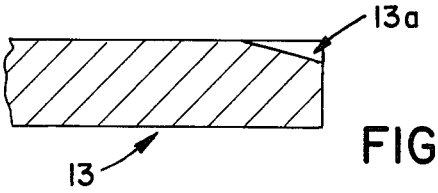
FIG. 7 is a view taken along cross-section lines AA of FIG. 5 showing a non-rotation lock slot provided on the housing of the filter assembly in accordance with the invention.
Figure 11:
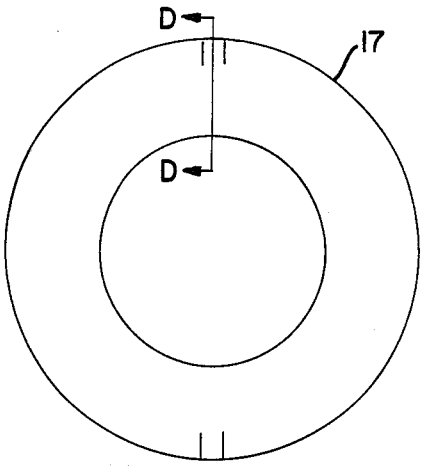
FIG. 11 is a front view of the other washer assembly for establishing electrical contact with the capacitors, which is mountable on the other side of the capacitor housing with respect to the first washer assembly.
Figure 12:
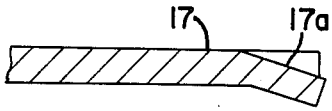
FIG. 12 is a partial cross-sectional view taken along lines DD of FIG. 11 showing a locking tab engageable with the locking slot of the capacitor housing for preventing rotation of the entire assembly.

As shown in greater detail in FIG. 5, the capacitor housing ring 13 which is made of plastic insulative material includes preferably at least two capacitor housing cavities 11*a* which are also shown in FIG. 6. Arrows AA of FIG. 5 designate a non-rotating slot portion which, as shown in cross-section in FIG. 7, shows the cutout portion 13*a* which interlocks with bent tab 17*a* of FIG. 12 which corresponds to a bent tab of washer ring 17 to insure precise positioning of the various capacitor ring housing assemblies and washers. This cross-sectional view of FIG. 12 is taken along lines DD of FIG. 11 which shows one of the washer rings 17. As will be readily apparent to those of ordinary skill in this art, this is just one construction for the anti-rotation feature and other eguivalent structures can be substituted therefor.

The capacitor 11 electrical connection arrangement is shown in FIG. 8, and as shown therein, washer 15 includes a bent out spring tab 5*a* which serves to establish contact with one electrode end of capacitor 11 and for forcing it into contact at the other electrode end thereof against washer 17.

The positioning of the spring contact portions 15*a* is better shown in FIG. 9 and the details thereof shown in FIG. 10*a* which is a partial cross-sectional view taken along lines BB of FIG. 9. As can be seen therein, to provide the necessary spring force. the contact portion 15*a* is raised a predetermined distance C. An alternative construction of contact portion 15*a* is shown in FIG. 10*b*. As can be appreciated, the contact 15*a* can also be a discrete element and not integral to washer 15.

Figure 13:
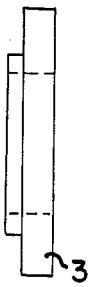
FIGS. 13 and 14 are respectively, side and front views of an insulator ring mountable on the connector for insuring that all conductive paths between the panel and the shield of a shielded cable is established only through the capacitors mounted in the capacitor housing in accordance with the invention.
Figure 14:
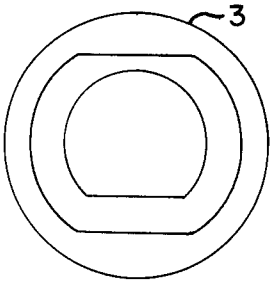

Finally, the insulating washer assembly 3 for use in accordance with the invention, and showing the lip which serves to isolate the housing 1, is more clearly shown in side view of FIG. 13 and front view of FIG. 14.

The entire assembly 9 is preferably interlocked together as a single discrete unit which can be simply and quickly mounted and assembled on an existing BNC connector by threading thereon and then locking with the lock washer and hex nuts 21, 23 shown in FIG. 2. The holding together of the assembly as a discrete unit can be done by adhesive or, by a conventional snap lock engagement arrangement.

As noted previously, enhanced performance is possible by using multiple capacitors in parallel, nstead of just one capacitor all within the same filter kit assembly. This is due to the lower impedance to the ground. In addition, the pre-assembly feature of the device minimizes assembly time for the end user and minimizes the skill aspect of making a good quality electrical connection compared to hand soldering. As noted, the device is presently intended for use on BNC type. front panel mount connectors although, as will be readily apparent to those of ordinary skill in the art. The concept could be extended for use on other types of connectors. The kit provides an add-on device for use on existing BNC type connectors and the method of connecting and retaining the capacitors provides for stress-isolation for the capacitors and thus, the physical forces encountered during installation will not damage the capacitor. Accordingly, significant improvements over the prior art are provided.

With respect to the materials employed, as noted previously, the capacitor ring 13 is preferably of plastic insulative material and although two cavities 11*a* are shown. more are possible depending upon the requirements as will be readily apparent to those of ordinary skill in the art. The inner washer spring 15, 15*a* assembly is preferably made of copper alloy to provide good conductivity. Likewise the outer washer 17 is also provided of copper alloy for good conductivity. Finally, the insulating washers 3 can be of insulating material such as plastic, preferably a nylon material. Although preferred materials have been discussed, it will be readily apparent to those of ordinary skill in the art that other materials having similar properties can be employed in place of the materials specifically enumerated herein.

What is claimed:

1. In a BNC type, front panel mount connector filter assembly of the type whereia capacitance is established between a BNC type, front panel mount connector and a panel upon which said connector is mounted for filtering high frequency interference by passing high frequencies from the connector body, which is in electrical contact with a cable shield, to the panel, the improvement wherein said filter assembly comprises:

capacitor housing means having ceramic chip capacitors mounted therein, said capacitor housing means comprising a ring made of electrically insulating material having capacitor housings therein and constructed for being mounted on the body of said connector when said connector is mounted on a conductive panel said capacitors being connected in parallel relative to each other between said panel and the shield of a cable;

first conductive washer means for establishing electrical contact between one termination of each capacitor mounted in said capacitor mounted in said capacitor housing means and said panel, and constructed for being mounted on the body of said connector on one side of said capacitor housing means;

second conductive washer means for establishing electrical contact between another termination of each capacitor mounted in said capacitor housing and a shield of a cable electrically connected to the connector body, and said second washer means constructed for being mounted on the body of said connector on the other side of said capacitor housing means and in electrical contact therewith; and lock means for holding said filter assembly on the connector body in contact with said panel upon which the connector is mounted.

2. A filter assembly as in claim 1 wherein said insulating material is a plastic.

3. A filter assembly as in claim 1 wherein insulating means is provided such that any electrical path between the connector housing and the panel is through the capacitors.

4. A filter assembly as in claim 1 wherein said capacitor housing means and first and second conductive washer means are interconnected together as one single unit.

5. A filter assembly as in claim 4 wherein said interconnection is achieved by adhesive.

6. A filter assembly as in claim 1 wherein said lock means comprises a lock washer and hex nut threadable onto the housing of a connector.

7. The combination of a filter assembly as in claim 1 with a BNC connector mounted on a panel.

* * * * *